US006322006B1

(12) United States Patent
Guo

(10) Patent No.: US 6,322,006 B1
(45) Date of Patent: Nov. 27, 2001

(54) SPRAYER DEVICE HAVING ADJUSTABLE HANDLE

(76) Inventor: Wen-Li Guo, No. 10, Fang Dong Road, Wen Gin Tsuen, Fang Yuan Hsiang, Chang Hua Hsien (TW)

( * ) Notice: Subject to any disclaimer, the term of this patent is extended or adjusted under 35 U.S.C. 154(b) by 0 days.

(21) Appl. No.: 09/740,141

(22) Filed: Dec. 20, 2000

(51) Int. Cl.[7] ..... B05B 15/06; A62C 31/24

(52) U.S. Cl. ..... 239/532; 239/525; 239/280; 239/280.5; 239/281; 239/531; 285/114; 285/302

(58) Field of Search ..... 239/280, 280.5, 239/281, 525, 531, 532; 285/114, 302, 339, 342

(56) References Cited

U.S. PATENT DOCUMENTS 2,257,585 * 9/1941 Auvil ..... 239/280
4,673,129 * 6/1987 Kologiy ..... 239/532
5,690,312 11/1997 Yang ..... 251/321
6,045,284 * 4/2000 Chiu ..... 285/302

* cited by examiner

*Primary Examiner*—Robin O. Evans
(74) *Attorney, Agent, or Firm*—Charles E. Baxley

(57) ABSTRACT

A sprayer device includes a tube extended from a sprayer member and a hose coupling the tube to a water reservoir. A pipe is slidably engaged on the hose and the tube. A control ferrule is engaged on the pipe and has an inclined inner peripheral surface for adjustable forcing and securing the pipe to the tube. One or more conduits may further be adjustably secured to the pipe. The pipe and the conduit may be easily and quickly adjusted relative to the tube and the pipe respectively and will not affect the water tight seal between the hose and the tube.

5 Claims, 2 Drawing Sheets

SPRAYER DEVICE HAVING ADJUSTABLE HANDLE

BACKGROUND OF THE INVENTION

1. Field of the Invention

The present invention relates to a sprayer device, and more particularly to a sprayer device having an adjustable handle and having a water tight seal.

2. Description of the Prior Art

Various kinds of typical sprayer devices, such as the sprayer guns, sprayer heads, sprayer nozzles include a handle having a port for coupling to the water supply with a hose or the like. U.S. Pat. No. 5,690,312 to Yang discloses one of the typical sprayer devices. The handles of the typical sprayer devices include an integral one-piece configuration and may not be adjusted to different lengths. For adjusting to different lengths, the other handles of different lengths may be selectively secured to the sprayer devices. However, the frequent engagement and disengagement of the various handles to the sprayer devices may damage the water tight seal between the sprayer devices and the handles.

The present invention has arisen to mitigate and/or obviate the afore-described disadvantages of the conventional sprayer devices.

SUMMARY OF THE INVENTION

The primary objective of the present invention is to provide a sprayer device including an adjustable handle and a water tight seal configuration.

In accordance with one aspect of the invention, there is provided a sprayer device comprising a sprayer member having a tube extended therefrom, the tube including a free end, a hose including a first end coupled to the free end of the tube and including a second end for coupling to a water reservoir, a pipe slidably engaged on the hose and including a first end slidably engaged on the free end of the tube, and a control ferrule engaged on the first end of the pipe for forcing the pipe to engage with the tube and to adjustably secure the pipe to the tube. The pipe may be easily moved and adjusted relative to the tube without affecting the water tight seal between the tube and the hose.

The pipe includes a barrel provided on the first end thereof, the barrel includes an outer thread provided thereon, the control ferrule is threaded with the outer thread of the barrel. The control ferrule includes an inclined inner peripheral surface formed therein for engaging with the barrel and for forcing the barrel to engage with the tube.

The pipe includes a second end, sprayer device further includes at least one conduit having a first end slidably engaged on the second end of the pipe, and a second control ferrule engaged on the first end of the conduit for forcing the conduit to engage with the pipe and to adjustably secure the conduit to the pipe.

The conduit includes a barrel provided on the first end thereof, the barrel includes an outer thread provided thereon, the second control ferrule is threaded with the outer thread of the barrel. The second control ferrule includes an inclined inner peripheral surface formed therein for engaging with the barrel and for forcing the barrel to engage with the pipe.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
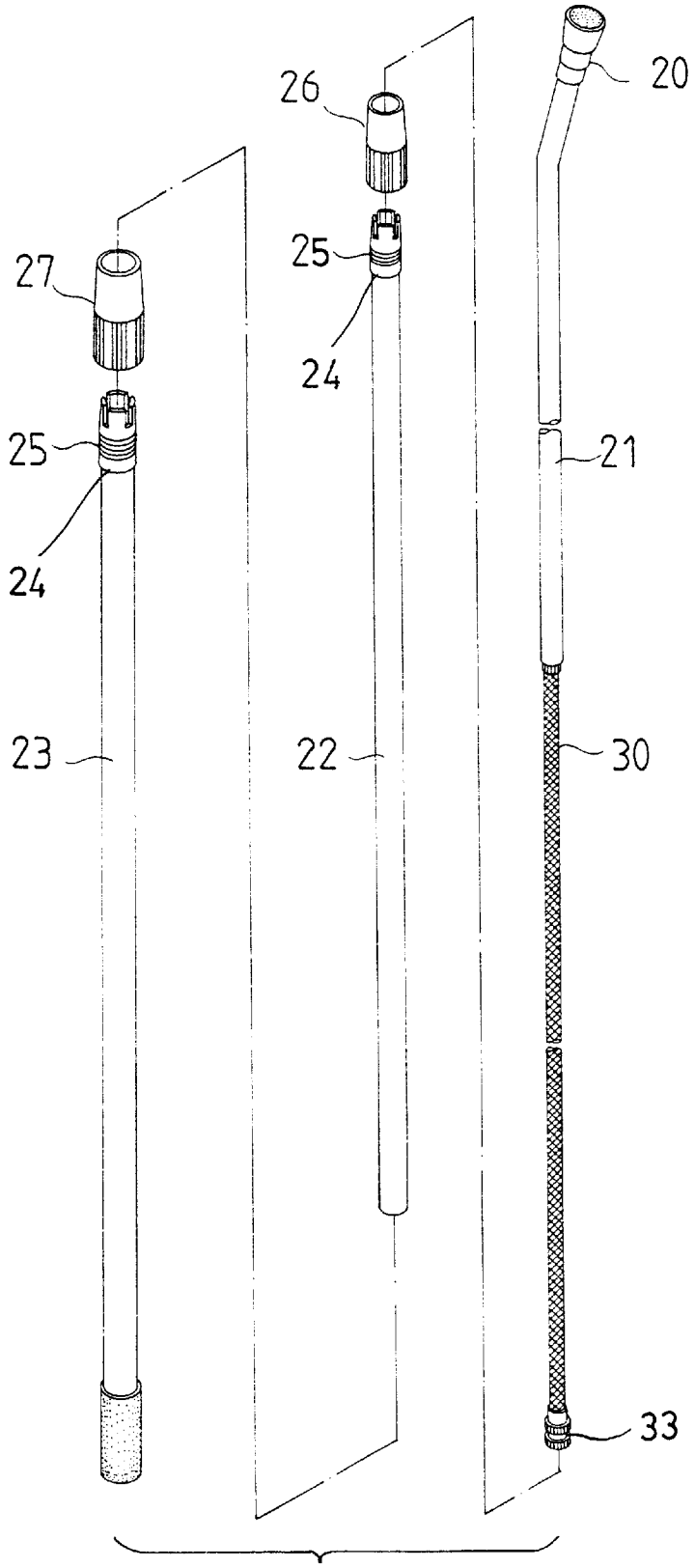
FIG. 1 is an exploded view of a sprayer device in accordance with the present invention.
Figure 2:
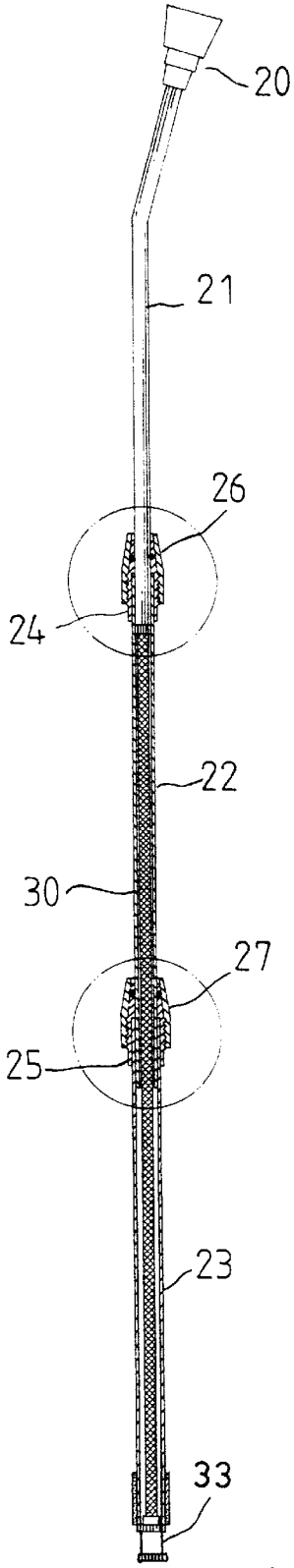
FIG. 2 is a plane schematic view of the sprayer device, in which a portion of the handle and the sprayer device is cut off for showing the adjustable configuration of the handle of the sprayer device.

Referring to the drawings, and initially to FIGS. 1 and 2, a sprayer device in accordance with the present invention comprises a sprayer member 20, a tube 21 extended from the sprayer member 20 or including one end coupled or secured to the sprayer member 20, a hose 30 including a first end secured to the other end or the free end of the tube 21 and a second end having a coupler 33 for coupling to the water reservoir or the like. The hose 30 may be a typical hose or a high pressure resistive hose. The sprayer device includes an adjustable handle having a pipe 22 and one or more conduits 23 adjustably coupled to the tube 21 and the pipe 22 respectively, for allowing the handle to be adjusted to different lengths.

A pipe 22 is slidably engaged onto the hose 30 and includes a first end slidably engaged onto the other end of the tube 21. A conduit 23 is also slidably engaged onto the hose 30 and includes a first end slidably engaged onto the other end or the second end of the pipe 22 The pipe 22 and the conduit 23 each includes a barrel 24 engaged on the first end thereof with such as a force-fitted engagement, and/or secured to the first end thereof with a welding process or the like. A sealing ring 28 may be engaged between the barrels 24 and the pipe 22 (FIG. 3) or the conduit 23 (FIG. 4) for making a water tight seal between the tube 21 and the pipe 22 and the conduit 23. The barrels 24 each includes an outer thread 25 formed or provided thereon.

Figure 3:
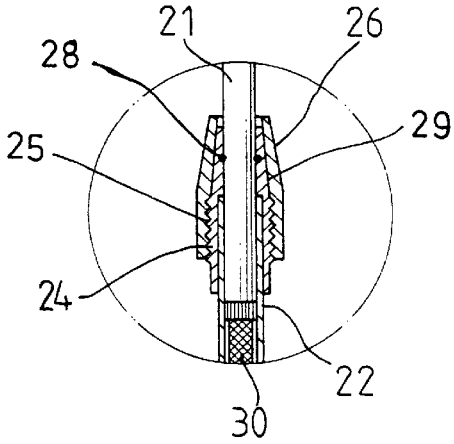
FIGS. 3 and 4 are enlarged partial cross sectional views illustrating the adjustable configuration of the handle of the sprayer device.

A control ferrule 26 includes an inner thread formed therein for threading with the outer thread 25 of the barrel 24 and includes a frustum-shaped inner peripheral surface or an inclined inner peripheral surface 29 for engaging with the barrel 24 and for selectively forcing the barrel 24 to forcefully and tightly engage with and secure to the pipe 22 (FIG. 3). Another control ferrule 27 also includes an inner thread formed therein for threading with the outer thread 25 of the barrel 24 and includes a frustum-shaped inner peripheral surface or an inclined inner peripheral surface for engaging with the barrel 24 and for selectively forcing the barrel 24 to forcefully and tightly engage with and secure to the conduit 23 (FIG. 4).

Figure 4:
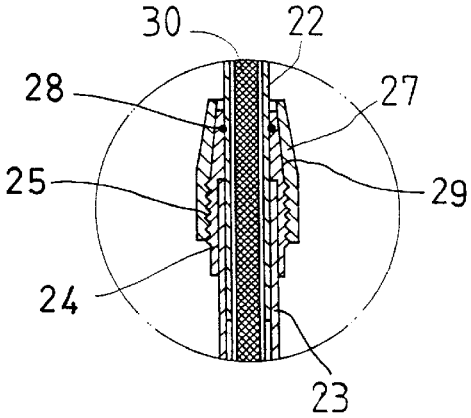

In operation, as shown in FIGS. 2–4, the control ferrules 26, 27 may be unthreaded relative to the barrels 24 for releasing the barrels 24 from the tube 21 and the pipe 22 respectively and for allowing the pipe 22 to be slided and moved and adjusted relative to the tube 21 before the control ferrule 26 is tightly engaged with the barrel 24, and for allowing the conduit 23 to be slided and moved and adjusted relative to the pipe 22 before the control ferrule 27 is tightly engaged with the barrel 24. The pipe 22 may thus be adjusted relative to the tube 21 and the conduit 23 may thus be adjusted relative to the pipe 22 for allowing the handle (22, 23) of the sprayer device to be adjusted to different lengths.

It is to be noted that the hose 30 is tightly and solidly secured to the tube 21. The slidable adjustment of the pipe 22 relative to the tube 21 and the conduit 23 relative to the pipe 22 will not affect the tight and solid securing of the hose

30 to the tube 21, and thus will not affect the water tight seal from the water reservoir to the sprayer member 20. The tube 21 may also be taken as one portion of the handle of the sprayer device.

Accordingly, the sprayer device in accordance with the present invention includes an adjustable handle and a water tight seal configuration.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A sprayer device comprising:

a sprayer member having a tube extended therefrom, said tube including a free end, a hose including a first end coupled to said free end of said tube and including a second end for coupling to a water reservoir, a pipe slidably engaged on said hose and including a first end slidably engaged on said free end of said tube, and said pipe including a second end, a control ferrule engaged on said first end of said pipe for forcing said pipe to engage with said tube and to adjustably secure said pipe to said tube, at least one conduit having a first end slidably engaged on said second end of said pipe, and a second control ferrule engaged on said first end of said at least one conduit for forcing said at least one conduit to engage with said pipe and to adjustably secure said at least one conduit to said pipe.

2. The sprayer device according to claim 1, wherein said pipe includes a barrel provided on said first end thereof, said barrel includes an outer thread provided thereon, said control ferrule is threaded with said outer thread of said barrel.

3. The sprayer device according to claim 2, wherein said control ferrule includes an inclined inner peripheral surface formed therein for engaging with said barrel and for forcing said barrel to engage with said tube.

4. The sprayer device according to claim 1, wherein said at least one conduit includes a barrel provided on said first end thereof, said barrel includes an outer thread provided thereon, said second control ferrule is threaded with said outer thread of said barrel.

5. The sprayer device according to claim 4, wherein said second control ferrule includes an inclined inner peripheral surface formed therein for engaging with said barrel and for forcing said barrel to engage with said pipe.

* * * * *